US005622090A

United States Patent [19]

Marks

[11] Patent Number: 5,622,090

[45] Date of Patent: Apr. 22, 1997

[54] SCALLOPED INTERIOR SOCKET TOOL

[75] Inventor: Joel S. Marks, Los Angeles, Calif.

[73] Assignee: WorkTools, Inc., Chatsworth, Calif.

[21] Appl. No.: 633,860

[22] Filed: Apr. 16, 1996

Related U.S. Application Data

[63] Continuation-in-part of Ser. No. 544,314, Oct. 17, 1995.

[51] Int. Cl.[6] ..... B25B 13/58

[52] U.S. Cl. ..... 81/185; 81/DIG. 11; 269/266

[58] Field of Search ..... 81/179, 185, 436, 81/442, 448, DIG. 11; 269/266

[56] References Cited

U.S. PATENT DOCUMENTS

| | | | |
|---|---|---|---|
| 3,674,070 | 7/1972 | Mahoney | 81/185 X |
| 3,698,267 | 10/1972 | Denney | 81/185 |
| 4,416,173 | 11/1983 | Rebish . | |
| 5,235,878 | 8/1993 | Young . | |
| 5,289,997 | 3/1994 | Cook | 81/185 X |
| 5,299,473 | 4/1994 | Weber et al. . | |

*Primary Examiner*—James G. Smith
*Attorney, Agent, or Firm*—Paul Y. Feng; Fulwider Patton Lee & Utecht

[57] ABSTRACT

A self-forming socket having a plurality of retractable pins bundled in parallel within a housing. The bundled pins may displace longitudinally and are biased by spring force away from a frame onto which the pins are slidably held. A spacer pin may be positioned at the center of the socket and is similarly biased away from the frame under spring force. When the socket is forced over a fastener, nut, or bolt head, groups of pins are pushed inward toward the frame and into the housing thereby conforming the pins to the contours of the fastener. Applying a torque to the socket transfers the torque through the bundled pins to the fastener. Each pin has a circular cross-section and an enlarged head and the interior walls of the housing containing the bundled pins has a hexagonal shape and may not contain any right angles. Grooves can be formed in the sides of the hexagonal shape to receive therein circular sides of adjacent ones of the enlarged heads. The pins are packed in a hexagonal arrangement.

15 Claims, 6 Drawing Sheets

Fig. 7
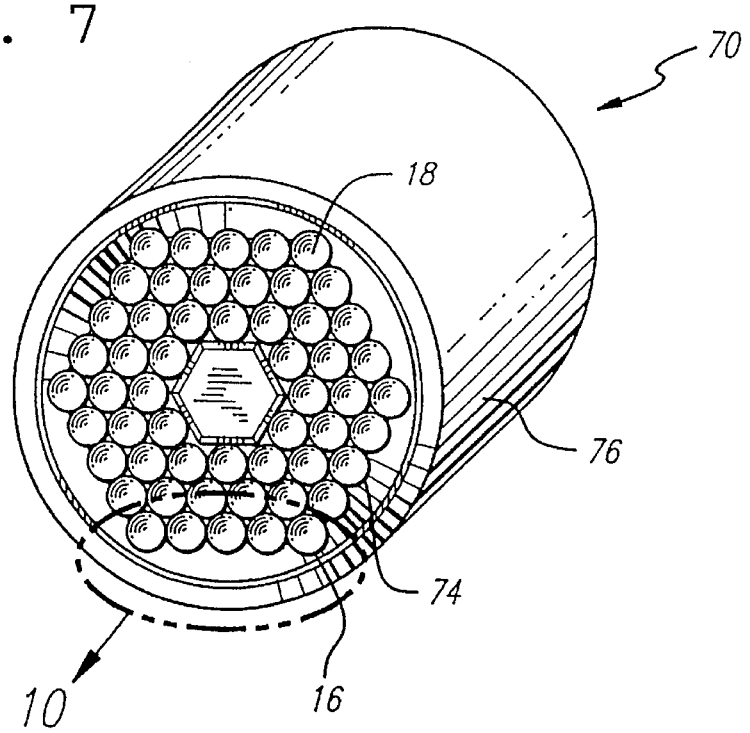
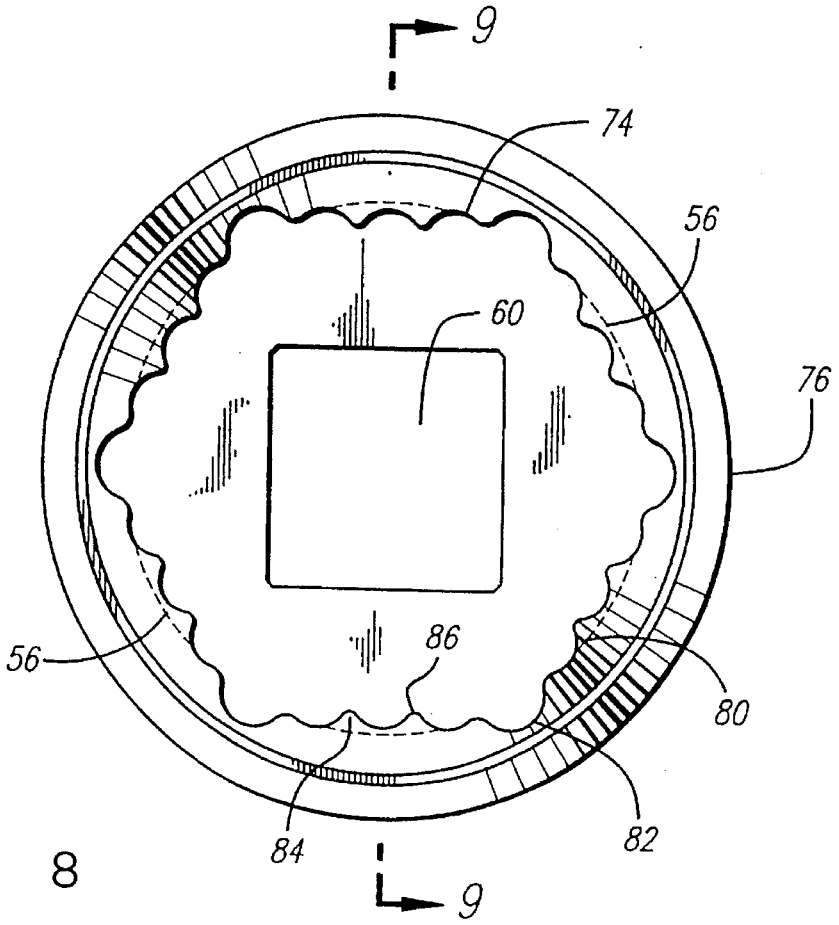
Fig. 8

SCALLOPED INTERIOR SOCKET TOOL

CROSS-REFERENCE TO RELATED APPLICATION

This is a continuation-in-part of copending application Ser. No. 08/544,314, filed Oct. 17, 1995, whose entire contents are hereby incorporated by reference.

BACKGROUND OF THE INVENTION

The present invention relates to socket tools. More precisely, the present invention relates to self-forming sockets that adjust to nuts and bolt heads of different sizes and shapes.

Many of today's machines are assembled using bolts, nuts, wing-nuts, screws, and similar fasteners. In order to work with such fasteners, wrenches and socket sets are often needed. Unfortunately, there is a large variety of such fasteners. Even for a standard hex-head bolt, there are numerous English and metric sizes. For a craftsman to be fully prepared to work with such a myriad of bolts, he must maintain a large assortment of socket sizes, and sometimes that assortment must include different socket shapes. Having to locate the correct size socket-head and switching between different sized socket-heads to use in conjunction with a wrench or power tool are cumbersome and inconvenient tasks.

As a result, there have been developments into sockets that self-adjust to the particular size and shape of the bolt head or nut. For example, U.S. Pat. No. 3,858,468 to Pasbrig et al. discloses a clamping tool having a housing with a chamber therein and an opening at one end. A plurality of bundled, square shape bars are disposed in the chamber, wherein the bars are individually displaceable inward of the housing against the spring action of a pad. As the tool is pushed over the head of a bolt or a nut, the bars in contact retract into the pad and surrounding the nut or bolt head thereby gripping the part. The bolt head or nut can then be torqued as necessary. U.S. Pat. No. 3,698,267 to Denney discloses fastener actuator having a plurality of fastener engaging elements, wherein the elements are bundled and slide independently and longitudinally into and out of the actuator to accommodate a bolt head, nut, or slotted screw-head. Each element has a rectangular cross-section in order to grip the flat sides of a standard bolt head, or to fit into the flat walls of a slotted screw-head.

U.S. Pat. No. 4,887,498 to Zayat discloses a tool for form engaging and turning components such as nuts, bolts, and screws. In its basic form, the Zayat device includes a chamber which in turn supports a bundle of pins each of which is adapted to slide farther upwardly into the chamber when the lower pin end contacts the component at the lower end of the housing. Each of the pins has flat sides and sharp corners in order to engage a nut either by the flat sides or the sharp corners.

U.S. Pat. No. 3,349,655 to Locke discloses an adjustable tool for installing or removing fasteners of various sizes, comprising of a bundle of rods surrounded by a girdle and resiliently mounted in a chuck. The rods may be pressed into conformity with the head of a fastener, and upon the application of torque to the chuck, the girdle constricts and accordingly torque is applied to the fastener through the rods. Each of the rods has flat sides and the rods of the bundle are tightly packed.

U.S. Pat. No. 1,529,605 to Muncey discloses a wrench having closely packed and individually extendable rods that engage a bolt head or nut. Each of the extendable pins has a rectangular shaped cross-section.

The foregoing teach methods of gripping a three dimensional object by using polygonal shape pins closely packed in parallel in a bundle and independently displaceable longitudinally to accommodate the height dimension and contours of the device to be gripped. This construction has been used in a vise as well, as disclosed in U.S. Pat. No. 2,754,708 to Peterson.

There have been other attempts at self-adjusting sockets. For instance, U.S. Pat. No. 5,157,995 to Nogues discloses a multiple socket wrench comprised of several coaxially disposed socket members housed within each other. The sockets are spring loaded and each has a reduced diameter towards the outer end that prevents the abutting sockets contained therein from falling off as a result of gravity or the spring force of the different spring members associated with each one of the sockets. Each spring urges each socket outwardly, and the springs of the sockets that are smaller than the head of the bolt or screw being matched are overcome and retracted, thereby automatically matching the correct size socket to the head of the bolt or nut. Additionally, U.S. Pat. No. 2,711,112 to Durand discloses another multiple socket wrench having coaxially aligned sockets of varying sizes organized on the ratchet in a concentric arrangement.

U.S. Pat. No. 5,193,420 to Smith is directed to a universal wrench for use with vehicle lug nuts. A two piece housing containing a plurality of spring-biased retractable round pins is shown. The pins are spaced apart from each other to allow assembly of the tool and to allow placement of adaptor cones on the end of each pin. These round pins appear to function independently of each other since the pin distal ends are spaced from any further components in a non-contacting arrangement. Hence, the pins must transmit torque to a fastener by bending forces along their length. The pins cannot be closely packed since the pin head 25 is of a second diameter greater than a first diameter of the engaging pin 24, which is the portion which engages a fastener. The pin heads 25 must further be spaced from each other to be contained within the first housing 11.

In view of the foregoing, however, there is still a need for a self-forming socket that self-adjusts and form fits to various sizes and shapes of bolt heads, nuts, screws, etc. with a hexagonal overall shape and without harmful sharp cornered pins.

SUMMARY OF THE INVENTION

It is therefore an object of the present invention to provide a self-forming socket that form fits a large variety of nuts and bolt heads of different shapes and sizes. It is another object to provide a self-forming socket which is optimized to fit large, hexagonal type bolt heads. It is yet another object of the present invention to provide a self-forming socket that tends not to strip the bolt head or nut by use of specially shaped pins. It is still another object of the present invention to provide a self-forming socket that adjusts to wing-nuts, broken nuts, square nuts, and other uniquely shaped fasteners. It is a further object of the present invention to provide a self-forming socket that may be readily assembled by automated methods.

In order to accomplish the foregoing objects, the present invention provides a self-forming socket comprising a frame having a plurality of openings therethrough, a plurality of pins closely packed in parallel, each pin having top and bottom ends and an arcuate cross-sectional shape, wherein the bottom ends pass through respective openings in the frame and are slidably mounted thereto, a spacer pin slidably disposed in a central location on the frame, biasing members disposed on each pin urging the top end away from the frame, and a housing partially enclosing the frame, pins, and spacer pin wherein the top ends of the pins in their extended state are exposed through the housing.

Importantly, the present invention provides a socket having bundled pins that have a circular cross-section, absent any sharp corners. The round pins avoid many problems caused by sharp edged or flat sided pins seen in the conventional sockets, which for example can dig into bolt heads, leave burrs, or fractures. Also, each pin having a preferably circular cross-section more easily adapts to the variety of nut and bolt head shapes. Round pins also pack well in a hexagonal cavity. The interstitial spaces between pins helps the pins conform more closely to the shape of the nut or bolt-head.

A pin having a relatively circular cross-sectional design facilitates manufacturing by cold forming methods, which is a high speed, low cost process. Sharp cornered pins, as in the prior art, cannot practically be made by such means.

In a preferred embodiment, the biasing member is a compression spring that returns the pin to an extended position away from the frame when the socket is disengaged from the fastener. The present invention in a preferred embodiment also includes a spacer pin slidably disposed at a central location on the frame. The spacer pin occupies an area at the center of the bundle of pins and helps center a fastener when the socket is first placed thereon. Advantageously, the spacer pin also reduces the number of individual pins required, thereby saving material costs.

In operation, a non-circular shaped head fastener is pressed into the face of the present invention self-forming socket, thereby depressing the spacer pin into the housing along with a certain grouping of pins. The remaining pins surrounding the fasteners do not retract and are biased away from the frame and housing by coiled springs. Those extended pins surround the fastener and cause the fastener to be wedged inside the housing.

The present invention using circular cross-section pins provides a tight grip on a large variety of fasteners. In particular, the pins function entirely by wedging the fastener within the housing. The pins do not slide over each other because the tightly packed containment of the pins within the housing leaves the pins with no room to move out of place. With this operating principle, round pins are a practical option over the conventional flat sided pins.

Moreover, the present invention does not have a conventional, rectangular housing interior; rather, the present invention has a polygonal shaped interior wherein none of the adjoining walls forms right angles. In the preferred embodiment, the interior walls form a hexagon, thus conforming to the hexagonal shape of an industry standard nut or bolt head. Empirical observations have shown that the hexagonal interior is well suited for the above described pin wedging principle.

In the preferred embodiment, the frame is made from an elastomeric material so that the enlarged ends of individual pins can be forced fit therethrough and slidably retained on the frame. Yet if removing a jammed fastener causes a pin to be forced back out through the frame, the pin and frame cannot be damaged, because the elastomeric frame gives way. Also, a pin that may be damaged in some way can easily be pulled out and replaced.

Likewise, the central spacer pin is forced fit through the frame and is held in place by an oversized end. A damaged spacer pin can be forcibly separated from the frame by a tug for replacement when needed.

Due to the uniquely round shape of the pins, interior walls of the socket can be shaped into a hexagon, and need not have a rectangular or square shape as is typical in prior art sockets. Naturally, the hexagonal shape socket fits on hexagonal shape fasteners more easily. In addition, the presence of the spacer pin and its hexagonal shape allow for quick alignment and fitment of the socket to the fastener.

In an alternative embodiment, the pins could be designed to have a polygonal cross-section, such as a triangle, hexagon, or a combination round cornered and flat sided shape. The limitation is that the pins should pack into the hexagonal interior cavity of the housing.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

The objects, features, and advantages of the present invention will be apparent to one skilled in the art from reading the following detailed description in which:

FIG. 7 is a view similar to FIG. 1 of an alternative preferred self-forming socket of the present invention;

FIG. 8 is an end view of the housing of FIG. 7 illustrated in isolation;

DETAILED DESCRIPTION OF PREFERRED EMBODIMENTS OF THE INVENTION

The following specification describes a self-forming socket. In the description, specific materials and configurations are set forth in order to provide a more complete understanding of the invention. However, it is understood by those skilled in the art that the present invention can be practiced without those specific details. In some instances, well-known elements are not described precisely so as not to obscure the invention.

The present invention is directed to a self-forming socket. The socket in a preferred embodiment has a plurality of pins closely packed in parallel and slidably disposed on a flat frame and enclosed within a housing with an open end. When the socket is fit onto a fastener such as a wing nut, bolt head, hex nut, etc., groups of the slidable pins are pushed into the housing to conform to the contours of the fastener. The axial shifting of the pins closely conforms the entire bundle to the specific contours of the fastener. When the socket is connected to a wrench, any torque on the wrench translates into a torque on the fastener via the bundled pins.

Figure 1:
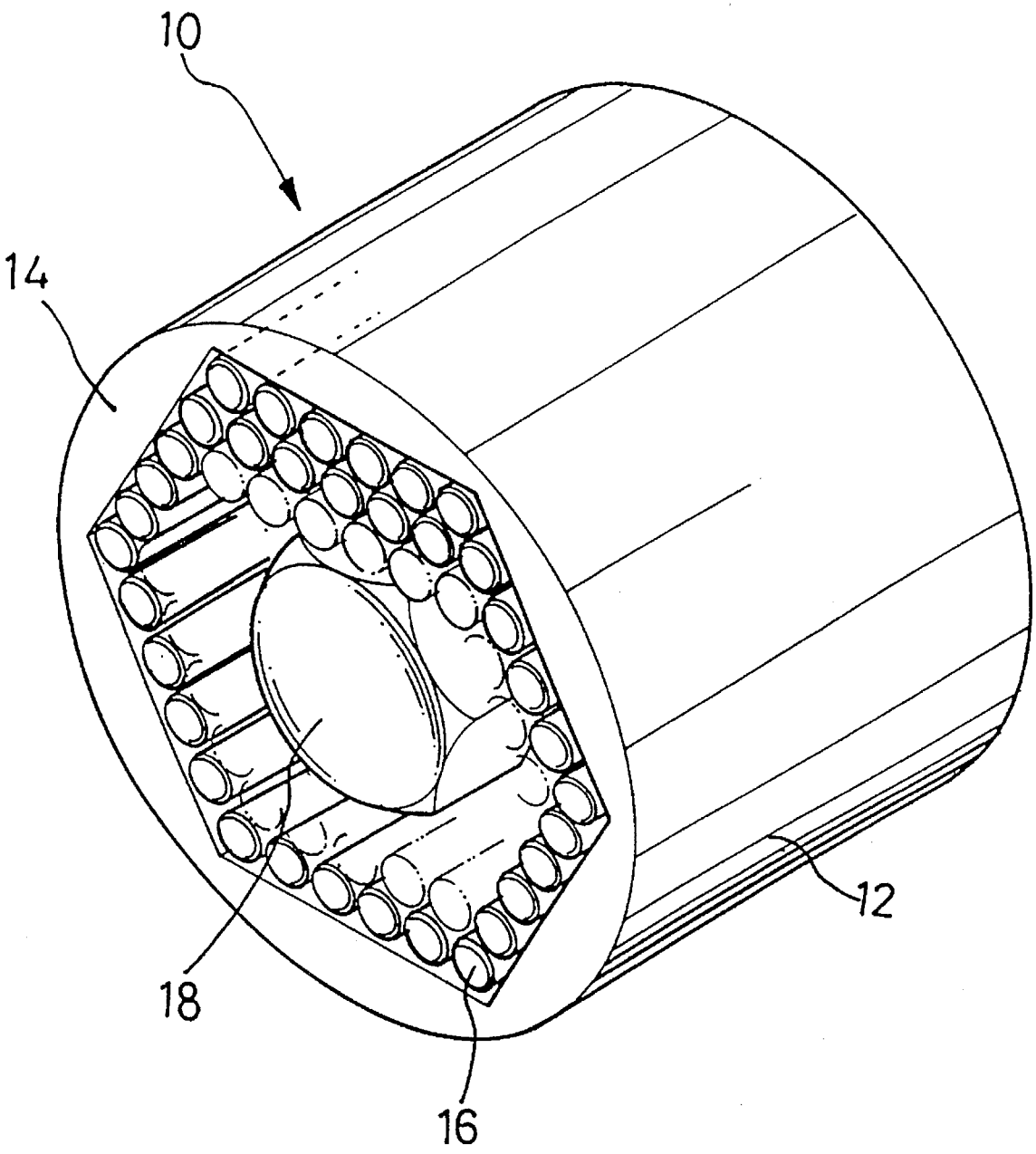
FIG. 1 is a perspective view of an embodiment of the present invention self-forming socket wherein a spacer pin and the surrounding bundled pins are in the extended position.

FIG. 1 is a perspective view of an embodiment of the present invention self-forming socket 10. The socket 10 is comprised of a housing 12, having an open end 14 exposing a plurality of pins 16 packed or bundled in parallel. Preferably at the center of the packed pins 16 is a spacer pin 18, which is used to reduce the total number of pins and to help center the socket 10 on the fastener.

Figure 2:
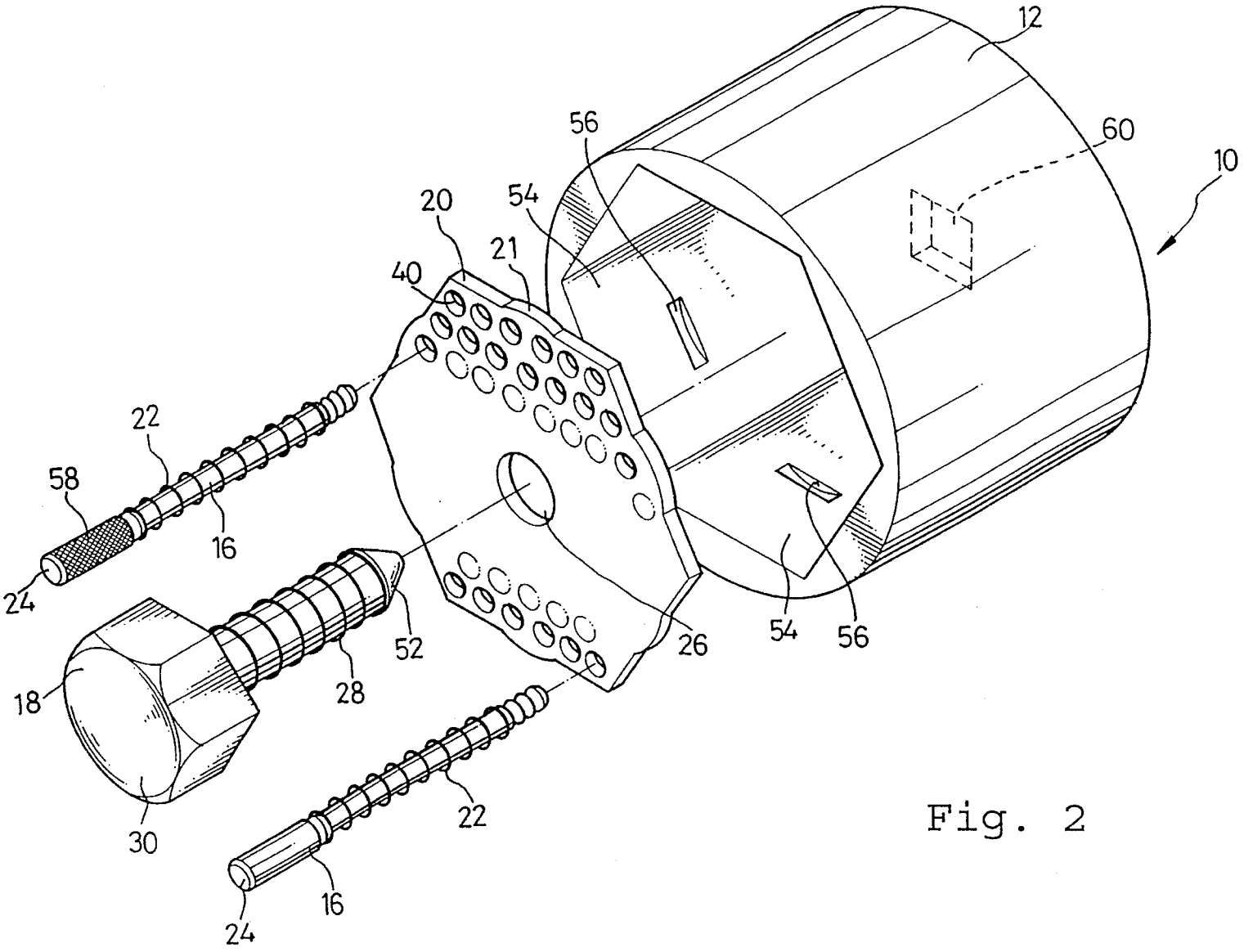
FIG. 2 is a perspective, exploded view of the present invention self-forming socket exposing the frame, pins, spacer pin, and compression springs.

FIG. 2 is an exploded perspective view of the present invention socket 10 shown in FIG. 1. The figure has been simplified insofar as fewer pins 16 are illustrated for the sake of clarity. As explained above, the present invention includes a plurality of pins 16 that are bundled in parallel, and as shown in FIG. 2, S each pin 16 is slidably disposed on a polygonal shaped frame 20. The frame 20 is lodged in a groove, channel, or notch 56 formed inside the housing 12 by engagement with arcuate hub 21. Notch 56 is preferably circular within housing 12 to facilitate manufacture. In the preferred embodiment, each pin 16 includes a biasing member such as the coiled spring 22 shown here. The coiled spring 22 maintains the extended position of the pin 16 so that the top end 24 of each pin 16 is urged away from the frame 20. Spring 22 is preferably preloaded when pin 16 is in its fully extended state.

Likewise, spacer pin 18 passes through a respective opening 26 at a central location on the frame 20. A coiled spring 28 is installed longitudinally on the spacer pin 18 and biases the top end 30 away from frame 20. Spacer pin 18 is not specifically required, however. Rather, in an alternative embodiment, the central space of socket 10 could instead be filled with additional pins 16.

Figure 4:
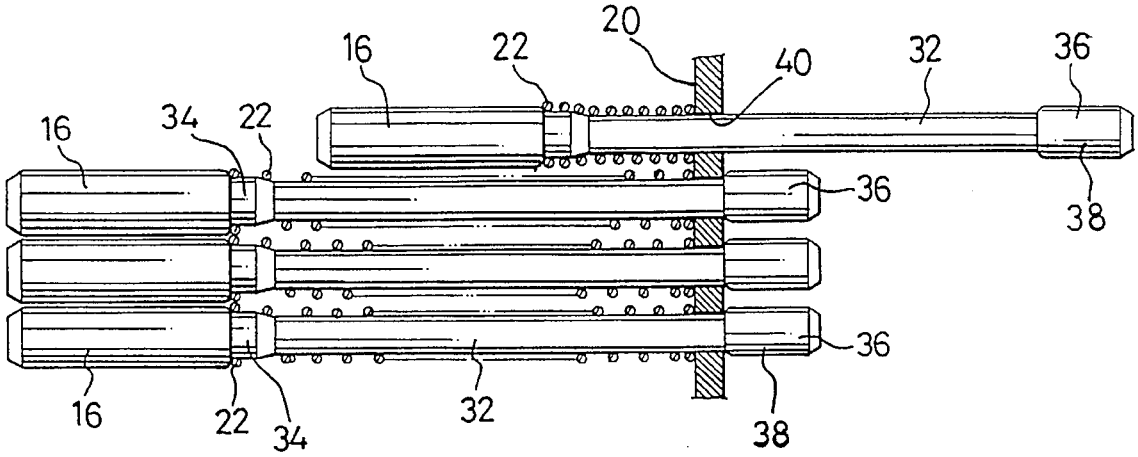
FIG. 4 is a side elevational view of the assembly of the bundled pins to the frame.

FIG. 4 provides a better view of the interaction between the pins 16 and the frame 20. As seen in this side elevational view, each pin 16 includes a shaft 32 onto which the coiled spring 22 is positioned. In a preferred embodiment, the shaft 32 has a raised shoulder 34 onto which the coiled spring 22 has a frictional fit. This keeps the coiled spring 22 attached to pin 16 when the pin is separate from the larger assembly.

In an alternative embodiment, a highly resilient sleeve made from rubber or sponge, for example, may be used in place of coiled springs. The resilient sleeve wraps around the pin and is compressed like a spring. In another alternative embodiment, a resilient pad may be positioned abutting the bottom end of the pin so that it is compressed when the pin retracts into the housing, whereby the rebound in the pad forces the pin back to its initial extended state.

At the bottom end 36 of each shaft 32 is an enlarged tip 38. The enlarged tip 38 creates an interference fit between it and the respective opening 40 in the frame 20. Beneficially, the enlarged tip 38 prevents the spring force of the coiled spring 22 from detaching the pin 16 from the frame 20. On the other hand, if necessary, the assembly of the pin 16 to the frame 20 and the disassembly of the pin 16 from the frame 20 can be accomplished by a push or tug to move the enlarged tip 38 through the open end 40.

Near the top end 24 of the pin 16, the outer surface may optionally have a textured surface 58 for an improved grip on the fastener, as seen in FIG. 2. The textured surface 58 can be in the form of a knurled pattern, grooves, ribs, or the like.

In a preferred embodiment, the frame 20 is made from a deformable material. In the exemplary embodiment shown, the frame 20 is made from an elastomeric material, such as polyurethane. This material has a degree of resiliency to improve the action of the pins 16 relative to the frame 20, assembly and disassembly of the pins 16 with their enlarged tips 38 through openings 40, and fitment of the frame inside the notch within the housing 12. Other stiffer plastics such as polyester are still resilient enough to function as frame 20. In a further embodiment a thin spring metal frame could be used. Openings 40 would have inward pointing fingers or other non-circular contours to provide resilient feature to allow passage of enlarged tip 38.

When socket 10 is pressed against a fastener, a group of pins 16 is forced toward the frame 20 and into the back of the housing 12. This action compresses the coiled spring 22 as shown in FIG. 4. Once the socket 10 is removed from the fastener, the coiled springs 22 return the group of pins 16 to their initially extended position where their respective enlarged tips 38 stop at the frame 20. Preferably, coiled spring 22 remains under load in its initially extended position.

Figure 5:
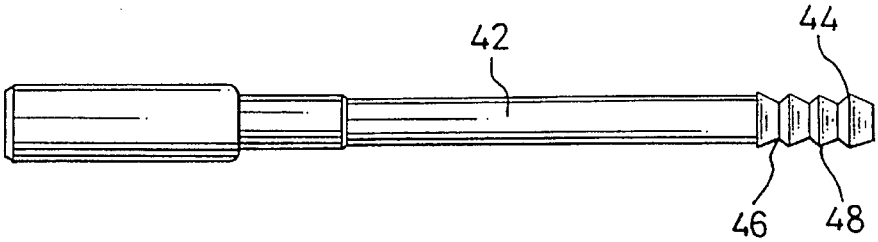
FIG. 5 is a side elevational view of an alternative embodiment pin shown in isolation.

FIG. 5 is a side elevational view of an alternative embodiment pin 42 of the present invention. In this embodiment, the bottom end 44 includes a series of grooves 46 and ridges 48. These grooves and ridges 46, 48 help retain the pin 42 onto the frame 20. Moreover, this structure is well suited for automatic roll forming processes.

Figure 6:
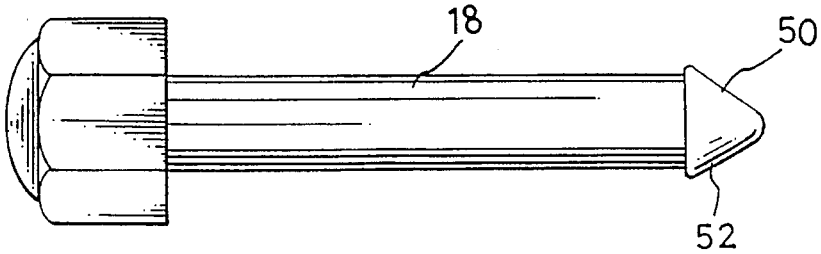
FIG. 6 is a side elevational view of a preferred embodiment spacer pin.

FIG. 6 is a side elevational view of a preferred embodiment spacer pin 18. At the bottom end 50 is an enlarged tip 52 designed to pass through opening 26 of the frame 20 with an interference or frictional fit. Accordingly, friction prevents the spacer pin 18 from accidentally disassembling or separating from the frame 20.

For the spacer pin 18, the bottom end 50 may optionally be designed to protrude through the back side of the housing 12 through opening 60, typically the attachment point to a lug of a standard wrench. Slight pressure on the protruding bottom end 50 can release the socket 10 from the fastener to which it is attached.

Use of the spacer pin 18 in the present invention economizes on the total number of pins 16 needed for each socket 10, thereby minimizing manufacturing and assembly costs. Moreover, the spacer pin 18 helps guide the user in quickly aligning the socket 10 onto a fastener. In the preferred embodiment, the spacer pin 18 is made from a polyurethane or like elastomer for toughness.

Figure 3:
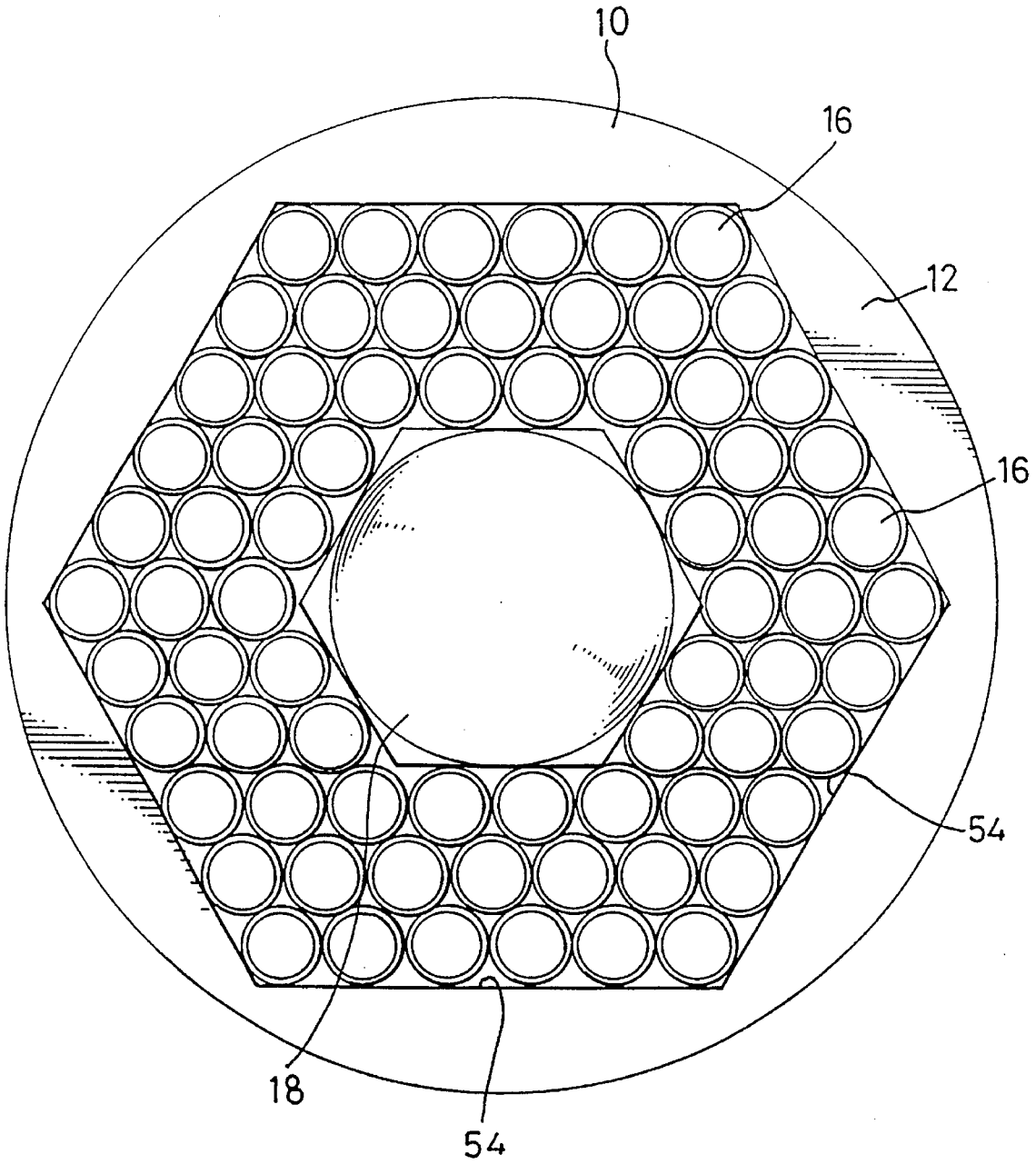
FIG. 3 is a plan view of the top end of the pins and spacer pin of the socket.

FIG. 3 is a plan view of the finished socket 10. The pins 16 are bundled or packed in parallel within the housing 12.

Most notably, the cross-sectional shape of the exemplary embodiment pin 16 is circular. There are many advantages of such a design.

From empirical observations, this circular cross-section provides a more predictable grip on any fastener and minimizes the possibility of digging gouges into the head of a conventional fastener. Of course, the cross-sectional shape of the pins 16 does not necessarily have to be circular, but preferably there are no flat sides or sharp corners on the pins 16. The lack of corners reduces the possibility of pin fracture simply because round pins have no corners to break off.

Moreover, the area moment of inertia of the round shaft is superior in resistance to bending as compared to conventional pins that have a polygonal shape. The greater resistance to bending is beneficial when high torque is needed for unscrewing rusted fasteners, stripped fasteners, lock nuts, etc.

As seen in FIGS. 2 and 3, the interior of the housing 12 is comprised of flat walls 54 that in a preferred embodiment form a hexagon. Importantly, because the pins 16 have a circular cross-section, the flat walls 54 can be arranged into the hexagonal shape, which is conducive to form fitting on a conventional hexagonal shaped fastener.

In prior art devices, the pins have a square, rectangular, or flat-sided shape cross-section. Some of the interior walls necessarily form right angles at the vertices as a means to rotationally engage the pin bundle. The present invention has no such limitation and through empirical observations it has been found to more easily conform to the hexagonal shapes of conventional fasteners. Furthermore, the larger angle between interior walls is not a limitation in torque transfer by virtue of the previously-described wedging principle.

Naturally, the flat walls 54 can be shaped into other polygonal configurations including pentagons, octagons, etc. Similarly, the spacer pin top end 30 can be formed to the same shape as the cross-section of the flat walls 54.

Figure 9:
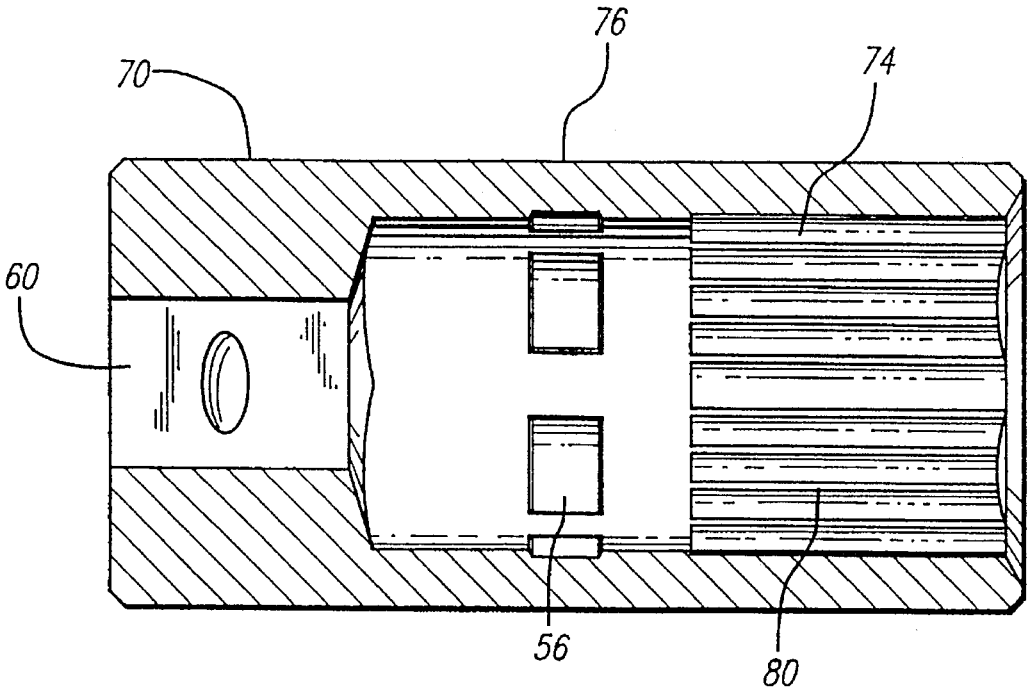
FIG. 9 is a cross-sectional view taken on line 9—9 of FIG. 8.
Figure 10:
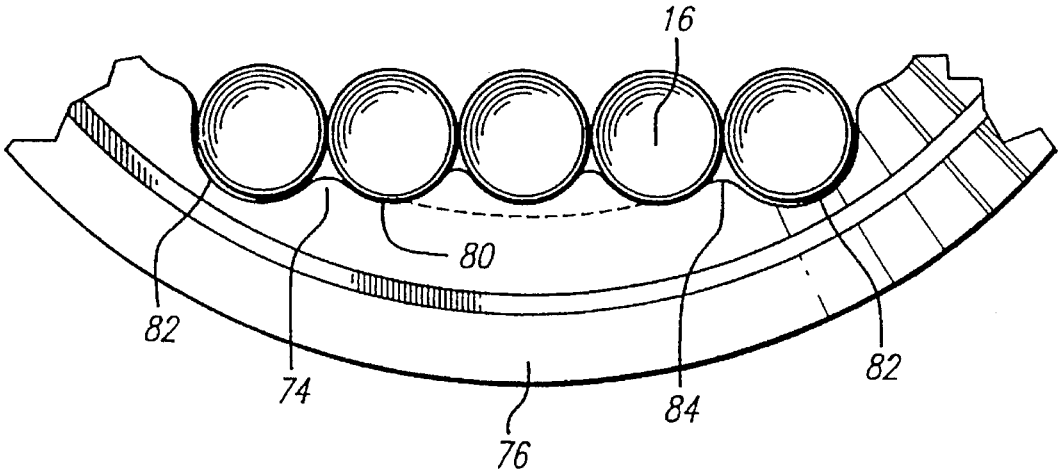
FIG. 10 is an enlarged view taken on circle 10 of FIG. 7.

A preferred embodiment of the present invention is shown generally at 70 in FIG. 7. It is essentially the same as the previously-described embodiments except that the interior walls 74 of the housing 76 have a scalloped configuration. More particularly, elongate curved (cylindrical) grooves or surfaces 80 are formed as shown in FIGS. 7, 8, and 9. They are formed between surfaces 84 of the hexagonal shape and preferably also at each corner forming grooves 82. As can be seen in FIGS. 8 and 10, during the same manufacturing operation which forms the hexagonal interior, surfaces 84 may be curved to ease manufacture.

Each one of these grooves or arcuate surfaces 80 receives a separate one of the pins 16 and more particularly the enlarged head portion 24 thereof, as illustrated in FIG. 2, for example. This allows for a tight contact with the interior wall 74. It holds the pins 16 in tight close parallel bunching with each other and the wall 74. Thereby the pins 16 transmit torque to a fastener through their large diameter engaging pin ends 24 directly to the wall 74 at the arcuate portions 80. Advantageously and unlike the prior art no bending and fracturing forces are generated along the length of the pin 16 by this torque transmission. The grooves ensure that the outer ring of pins 16 do not slide along walls 74 when the tool of the invention applies torque to a fastener. The radial outward wedging force imposed upon the pins by the fastener causes the outer ring of pins to be seated within grooves 80.

In FIG. 9, square opening 60 fits a typical ratchet wrench.

Grooves 80 may extend partially down interior walls 74 as shown in FIG. 9 or alternately fully down the length of walls 74 toward square opening 60.

In a further embodiment, surfaces of interior walls 74 or flat surfaces 84 extend slightly inward at the bottom edge of notch 56 to form shelf 86 in FIG. 8. Shelf 86 does not interfere with pins 16 but provides further support for frame 20, to prevent frame 20 from being pressed down past notch 56. In FIG. 8, grooves 80 extend below notch 56.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A self-forming socket comprising:

a housing assembly having an interior wall and a plurality of longitudinal openings;

a plurality of parallel pins, each having an elongate middle portion and an enlarged head end, said pins being slidable along respective said middle portions in respective ones of said openings, an outer ring of pins all in contact with said interior wall;

wherein said head ends are closely packed directly adjacent one another such that end forces thereagainst during transmission of torque to a fastener are transmitted outwardly through adjacent said pin head ends to said housing wall and not as significant bending forces to said elongate middle portion;

biasing means for biasing each of said head ends away from said respective openings; and wherein said interior wall has a plurality of curved surfaces into each of which fits a separate one of said enlarged heads of the pins of said outer ring.

2. The socket of claim 1 wherein said interior wall has a scalloped configuration.

3. The socket of claim 1 wherein a surface of the housing surrounding said head ends includes a chamfer.

4. The socket of claim 3 wherein said enlarged heads are each circular.

5. The socket of claim 3 wherein said interior wall has a hexagonal shape.

6. The socket of claim 1 wherein said housing assembly includes a housing and a separate frame assembled in said housing, said openings passing through said frame.

7. The socket of claim 6 wherein said housing includes a housing interior wall notch in which said frame is held.

8. The socket of claim 1 wherein said biasing means comprises coil spring means.

9. The socket of claim 1 wherein said biasing means comprises springs around each of said pin elongate portions.

10. The socket of claim 9 wherein said housing assembly includes a frame through which said openings pass, and said springs bias against said frame.

11. The socket of claim 1 further comprising a spacer member which is larger than said enlarged heads at a center of said housing assembly with a grouping of said pins.

12. The socket of claim 1 wherein each said enlarged head has a circular cross section.

13. The socket of claim 1 wherein said interior wall has a hexagonal shape.

14. The socket of claim 1 wherein said pins each include enlarged tail ends adapted to prevent free sliding of said pins forward out of said openings.

15. A self-forming socket comprising:

a housing assembly having an interior wall surrounding a separate frame, and a plurality of longitudinal openings through said frame;

said housing having an opening at a top end through which said frame is inserted for assembly into an interior of said housing;

a housing interior wall notch in which said frame is held;

an inward extension of said interior wall to form a shelf below said notch to support said frame;

a plurality of parallel pins, each having an elongate middle portion and an enlarged head end, said pins being slidable along respective said middle portions in respective ones of said openings, an outer ring of pins all in contact with said interior wall;

wherein said head ends are closely packed directly adjacent one another such that end forces thereagainst during transmission of torque to a fastener are transmitted outwardly through adjacent said pin head ends to said housing wall and not as significant bending forces to said elongate middle portion; and biasing means for biasing each of said head ends away from said respective openings.

* * * * *